US007537057B2

(12) United States Patent
Singeetham et al.

(10) Patent No.: US 7,537,057 B2
(45) Date of Patent: May 26, 2009

(54) SLIMLINE TIEBACK CONNECTOR

(75) Inventors: Shiva Singeetham, Houston, TX (US); Eric Baltmanis, Stirling (GB)

(73) Assignee: FMC Technologies, Inc., Houston, TX (US)

( * ) Notice: Subject to any disclaimer, the term of this patent is extended or adjusted under 35 U.S.C. 154(b) by 610 days.

(21) Appl. No.: 10/897,535

(22) Filed: Jul. 23, 2004

(65) Prior Publication Data

US 2007/0181309 A1 Aug. 9, 2007

(51) Int. Cl.
*E21B 29/12* (2006.01)
*E21B 7/12* (2006.01)

(52) U.S. Cl. ..... 166/343; 166/348; 166/365; 285/18

(58) Field of Classification Search ..... 166/344, 166/345, 359, 343, 348, 365; 285/18, 34, 285/123.1

See application file for complete search history.

(56) References Cited

U.S. PATENT DOCUMENTS

| | | | | | |
|---|---|---|---|---|---|
| 3,222,088 | A * | 12/1965 | Haeber | 285/18 |
| 3,321,217 | A * | 5/1967 | Ahlstone | 285/18 |
| 3,851,897 | A * | 12/1974 | Piazza et al. | 285/18 |
| 4,114,928 | A * | 9/1978 | Lochte | 285/18 |
| 4,433,859 | A * | 2/1984 | Driver et al. | 285/34 |
| 4,526,406 | A * | 7/1985 | Nelson | 285/18 |
| 4,606,557 | A | 8/1986 | Coffey | |
| 4,730,853 | A * | 3/1988 | Gjessing | 285/18 |
| 4,819,967 | A * | 4/1989 | Calder et al. | 285/18 |
| 4,902,044 | A * | 2/1990 | Williams et al. | 285/18 |
| 5,433,274 | A * | 7/1995 | Graff et al. | 166/368 |
| 6,035,938 | A * | 3/2000 | Watkins | 166/345 |
| 6,138,762 | A * | 10/2000 | Sweeney et al. | 166/359 |
| 6,142,233 | A * | 11/2000 | Wilkins | 166/339 |
| 6,234,252 | B1 * | 5/2001 | Pallini et al. | 166/345 |
| 6,540,024 | B2 * | 4/2003 | Pallini et al. | 166/348 |
| 6,557,638 | B2 * | 5/2003 | Cunningham et al. | 166/348 |
| 6,591,869 | B2 | 7/2003 | Bartlett | |
| 6,609,731 | B2 | 8/2003 | DeBerry et al. | |

* cited by examiner

*Primary Examiner*—Thomas A Beach
(74) *Attorney, Agent, or Firm*—Henry C. Query, Jr.

(57) ABSTRACT

A connector for securing a first cylindrical member to a second cylindrical member comprises a cylindrical body which includes a first end that is attached to the first member and a second end that is positioned proximate the second member, a cylindrical housing sleeve which is positioned concentrically over the body and which includes an upper end portion that is secured to the body and a lower end portion that is disposed adjacent the second member, a cylindrical primary piston that is positioned between the body and the housing sleeve, a locking mandrel which is connected to or formed integrally with the primary piston and which includes at least first and second annular portions that have different diameters, and a split lock ring which is supported by the lower end portion adjacent a number of locking grooves in the second member and which includes at least first and second cylindrical portions that correspond to the first and second annular portions of the locking mandrel. In operation, movement of the primary piston from a first position to a second position will force the first and second annular portions of the locking mandrel into engagement with the first and second cylindrical portions of the lock ring, respectively, and consequently force the lock ring into engagement with the locking grooves to thereby lock the connector to the second member.

20 Claims, 3 Drawing Sheets

SLIMLINE TIEBACK CONNECTOR

BACKGROUND OF THE INVENTION

The present invention relates to a connector for securing a first generally cylindrical member, such as a production riser, to a second generally cylindrical member, such as a subsea wellhead. More particularly, the invention relates to a connector which comprises a locking mandrel that includes a stepped surface which engages a corresponding stepped surface on a lock ring to thereby force the lock ring into locking engagement with the second member.

Tieback connectors are commonly used to secure production risers to subsea wellheads. Since the production riser extends to a surface vessel which is located a considerable distance from the wellhead, the production riser is typically subjected to sizeable forces which give rise to substantial separation forces between the tieback connector and the wellhead. Thus, the tieback connector must be able to maintain a sealed connection to the wellhead in the presence of these separation forces. In the past, this was accomplished by making the locking mandrel and the lock ring sufficiently large to withstand the separation forces. However, this in turn required the overall diameter of the tieback connector to be relatively large, which is undesirable when working from certain types of surface vessels.

SUMMARY OF THE INVENTION

In accordance with the present invention, these and other limitations in the prior art are overcome by providing a connector for securing a first cylindrical member to a second cylindrical member, the connector comprising a cylindrical body which includes a first end that is attached to the first member and a second end that is positioned proximate the second member, a cylindrical housing sleeve which is positioned concentrically over the body and which includes an upper end portion that is secured to the body and a lower end portion that is disposed adjacent the second member, a cylindrical primary piston that is positioned between the body and the housing sleeve, a locking mandrel which is connected to or formed integrally with the primary piston and which includes at least first and second annular portions that have different diameters, and a split lock ring which is supported by the lower end portion adjacent a number of locking grooves in the second member and which includes at least first and second cylindrical portions that correspond to the first and second annular portions of the locking mandrel. In operation movement of the primary piston from a first position to a second position will force the first and second annular portions of the locking mandrel into engagement with the first and second cylindrical portions of the lock ring, respectively, and consequently force the lock ring into engagement with the locking grooves to thereby lock the connector to the second member.

Thus, when the connector is locked to the second member, the stepped interface between the locking mandrel and the lock ring provides two distinct bearing surfaces through which separation forces acting between the first and second members are transmitted. In addition, the provision of these two distinct bearing surfaces tends to distribute the separation forces more evenly among all the locking grooves compared to prior art designs. Consequently, for a given anticipated set of separation forces, the overall diameter of the connector can be reduced.

These and other objects and advantages of the present invention will be made apparent from the following detailed description, with reference to the accompanying drawings.

DETAILED DESCRIPTION OF THE PREFERRED EMBODIMENTS

The slimline tieback connector of the present invention provides a simple yet effective means for remotely connecting two subsea hydrocarbon production members together. Although the slimline tieback connector can be used to connect any of a variety of subsea hydrocarbon production members, it is particularly useful for securing a first generally cylindrical member to a second generally cylindrical member in an end-to-end arrangement. For purposes of simplicity, however, the present invention will be described herein in the context of a connector for securing a production riser to a subsea welihead.

Figure 1:
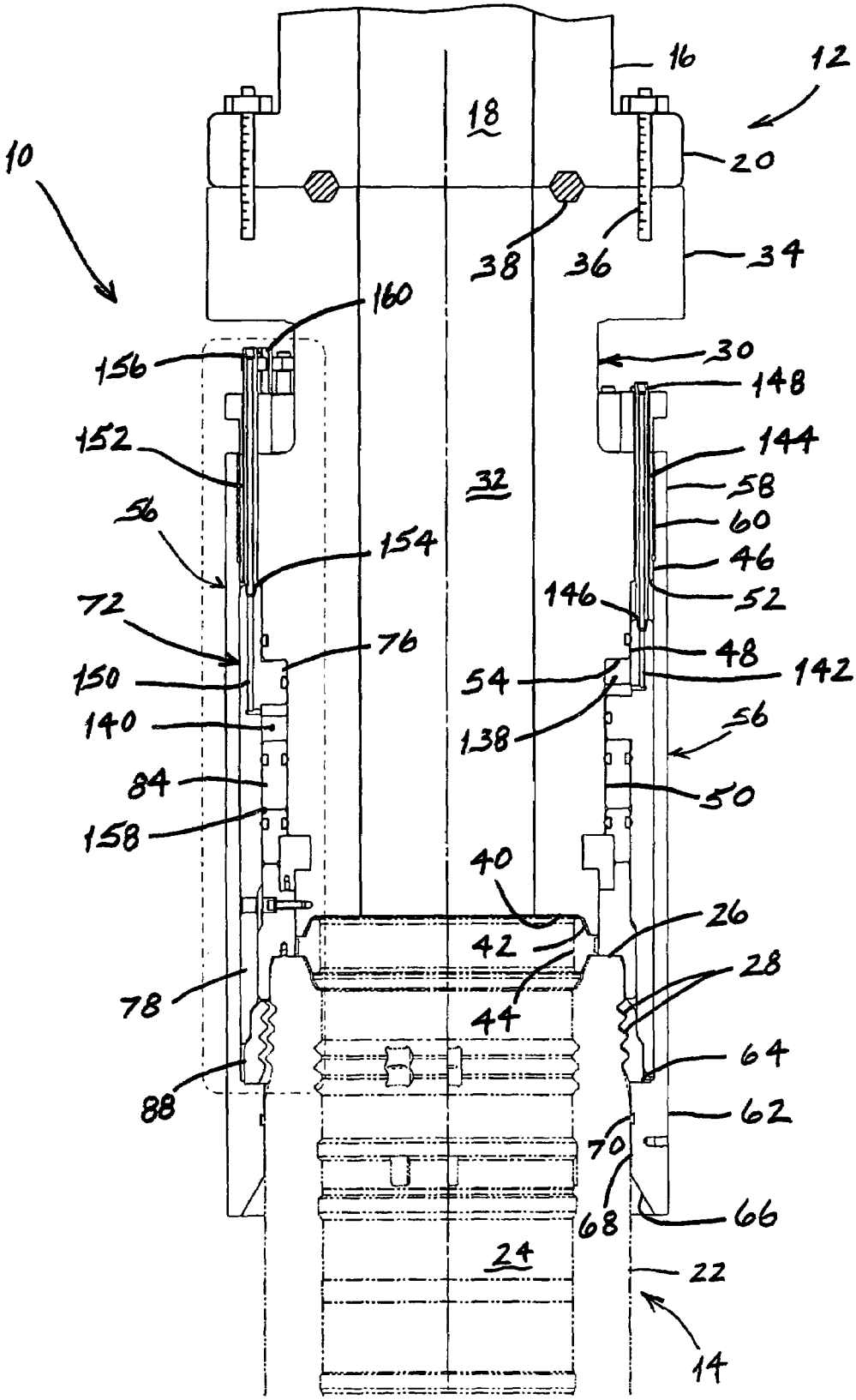
FIG. 1 is a longitudinal cross sectional view of the tieback connector of the present invention shown in the unlocked position on the left-hand side and in the locked position on the right hand side.

Referring to FIG. 1, the tieback connector of the present invention, which is indicated generally by reference number 10, is shown being used to secure a slimline production riser 12 to an exemplary subsea wellhead 14. The production riser 12 comprises a generally cylindrical riser body 16, a production bore 18 which extends axially through the riser body, and a bottom connection flange 20 which is located at the lower end of the riser body. The wellhead 14 includes a generally cylindrical wellhead body 22, a central bore 24 which extends axially through the wellhead body, a top shoulder 26 which is located at the upper end of the wellhead body, and a number of locking grooves 28 which are formed on the outer surface of the wellhead body proximate the top shoulder.

The tieback connector 10 comprises a generally cylindrical body 30 and a flow bore 32 which extends generally axially through the body. The body 30 may be formed integrally with an end of the production riser 12 or attached thereto using any suitable means. In the illustrated embodiment of the invention, for example, the body 30 includes a top connection flange 34 which is attached to the bottom connection flange 20 by a number of conventional stud and nut assemblies 36. The body 30 is preferably also sealed to the production riser 12 using a suitable gasket 38 which is positioned between the top and bottom connection flanges 34, 20.

The body 30 also comprises a bottom end 40 and a frustoconical seal surface 42 which is formed in or adjacent the bottom end. When the body 30 is secured to the wellhead 14, a suitable seal, such as a conventional VX-type gasket 44, engages the seal surface 42 and a corresponding seal surface on the wellhead 14 to thereby form a pressure tight seal between the body 30 and the wellhead. Thus, when the tieback connector 10 is attached to the production riser 12 and then subsequently secured to the wellhead 14, the flow bore 32 in the body 30 will fluidly connect the production bore 18 in the production riser with the central bore 24 in the wellhead.

In accordance with one embodiment of the invention, the body 30 further comprises a radial flange portion 46 which is located below the top connection flange 34, a first reduced diameter portion 48 which is located below the flange portion, and a second reduced diameter portion 50 which is located below the first reduced diameter portion. In addition, a first shoulder 52 is formed between the flange portion 46 and the first reduced diameter portion 48, and a second shoulder 54 is formed between the first reduced diameter portion and the second reduced diameter portion 50.

Referring still to FIG. 1, the tieback connector 10 also comprises a generally cylindrical housing sleeve 56 which is positioned concentrically over the body 30. The housing sleeve 56 includes an upper end portion 58 which is secured such as by threads 60 to the flange portion 46, and a lower end portion 62 which extends axially below the bottom end 40 of the body 30. The lower end portion 62 includes an inner radial ledge 64, a conical bottom face 66 and an inner annular surface 68 which is designed to form a close sliding fit with the outer surface of the wellhead 14. Thus, when the tieback connector 10 is landed on the wellhead 14, the conical bottom face 66 will align the tieback connector over the top shoulder 26 and the housing sleeve 56 will slide over the body 22. The housing sleeve 56 may also include a suitable wiper seal 70 which is positioned in a corresponding groove that is formed on the inner surface 68 of the lower end portion 62.

Figure 2:
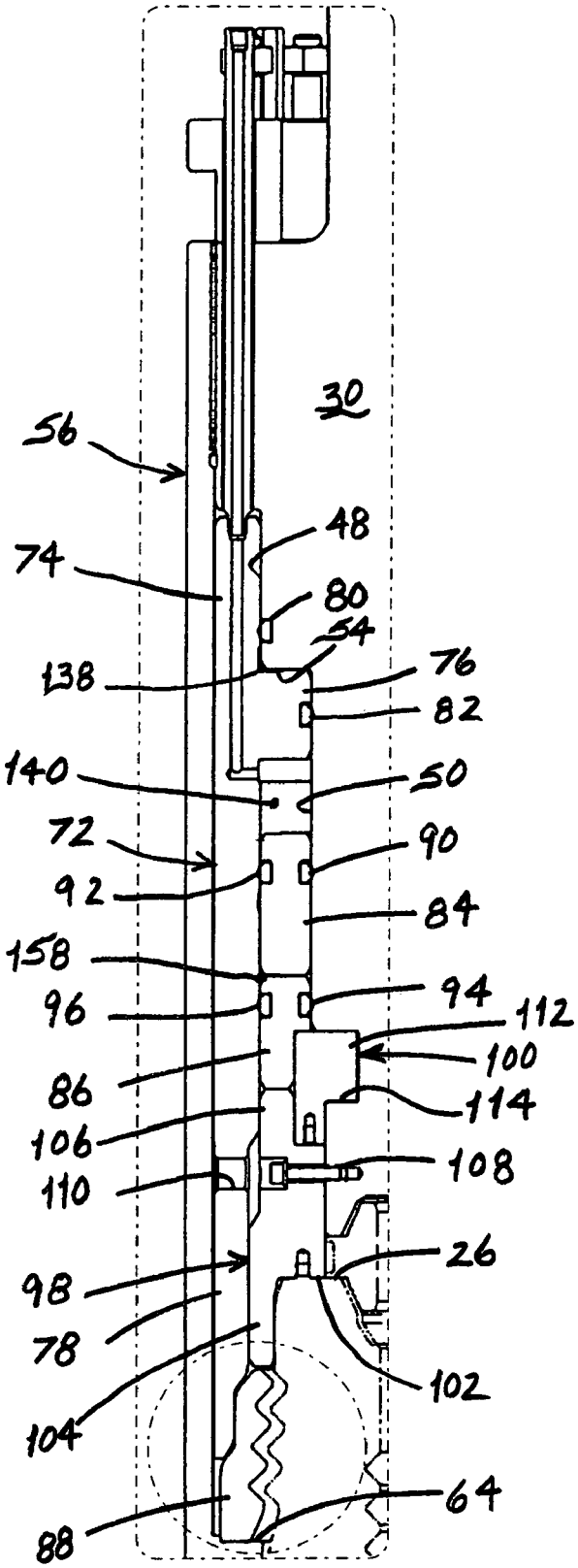
FIG. 2 is an enlarged view of a portion of the tieback connector shown in FIG. 1.

Referring to FIG. 2, the tieback connector 10 further comprises a generally cylindrical primary piston 72 which is located between the body 30 and the housing sleeve 56. The primary piston 72 includes an upper extension 74 which is positioned around the first reduced diameter portion 48 of the body 30, a head portion 76 which is positioned around the second reduced diameter portion 50 of the body, and a lower portion which is attached to or formed integrally with a locking mandrel 78 that extends downwardly toward the ledge 64 of the housing sleeve 56. In addition, the upper extension 74 is sealed to the body 30 with a first seal 80 and the head portion 76 is sealed to the body with a second seal 82. The first and second seals 80, 82 can be any suitable seals, such as non-metallic S-type face seals.

The tieback connector 10 also includes an optional ring-shaped secondary piston 84 which is located below the head portion 76, an annular seal sleeve 86 which is located below the secondary piston, and a lock ring 88 which is supported on the ledge 64. The secondary piston 84 is sealed to the body 30 with a third seal 90 and to the primary piston 72 by a fourth seal 92. In addition, the seal sleeve 86 is sealed to the body 30 by a fifth seal 94 and to the primary piston 72 by a sixth seal 96. As with the first and second seals 80, 82, the third through sixth seals 90 through 96 can be any suitable seals, such as non-metallic S-type face seals.

Referring still to FIG. 2, the tieback connector 10 may also include a hub ring 98 which supports the body 30 on the wellhead 14 and a bearing ring 100 through which the axial forces acting on the hub ring are transmitted to the body. The hub ring 98 includes a downwardly facing seat 102 which engages the top shoulder 26 of the wellhead 14, a lower leg 104 which extends axially over the wellhead toward the lock ring 88 and an upper retainer flange 106 which extends axially over the bearing ring 100 toward the seal sleeve 86. The hub ring 98 is optimally secured to the body 30 with a number of screws 108 which are accessed through corresponding holes 110 that are formed in the primary piston 72. The bearing ring 100 is ideally a conventional split-type ring which includes a radial lip 112 that is received in a corresponding groove 114 which is formed in the body 30. The segments of the bearing ring 100 are retained in the groove 114 by the retainer flange 106.

Figure 3:
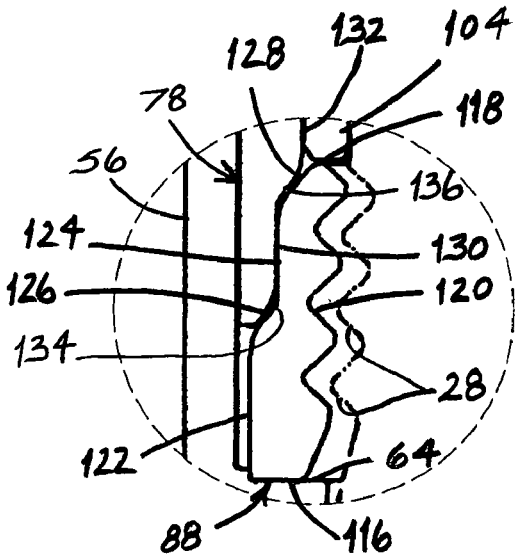
FIG. 3 is an enlarged view of a portion of the tieback connector shown in FIG. 2.

Referring to FIG. 3, the lock ring 88 is preferably a one-piece split ring which is biased radially outwardly toward the housing sleeve 56. The lock ring 88 comprises a bottom surface 116 which rests on the ledge 64, a top edge 118 which ideally abuts the bottom of the leg 104 of the hub ring 98, an inner surface which includes a locking profile 120 that corresponds to the locking grooves 28 on the wellhead 14, and a stepped outer surface which is adapted to be engaged by the locking mandrel 78. The outer surface comprises a first cylindrical portion 122 which extends upwardly from the bottom surface 116, a smaller diameter second cylindrical portion 124 which is located above the first cylindrical portion, a first conical portion 126 which is located between the first and second cylindrical portions, and a second conical portion 128 which is located between the top edge 118 and the second cylindrical portion. The locking mandrel 78 includes a stepped inner surface which closely corresponds to the outer surface of the lock ring 88. Thus, the inner surface comprises a first annular portion 130, a smaller diameter second annular portion 132 which is located above the first annular portion, a first tapered portion 134 which is located immediately below the first annular portion, and a second tapered portion 136 which is located between the first and second annular portions. The first and second cylindrical portions 122, 124, as well as the first and second annular portions 130, 132, are preferably substantially vertical to ensure that the locking mandrel 78 will not be forced out of its lowered position under the influence of the separation forces acting between the wellhead 14 and the tieback connector 10 when these surfaces are engaged.

In the unlocked condition of the tieback connector 10, which is shown in FIGS. 2 and 3, the primary piston 72 is in its raised position wherein the head portion 76 is located against the second shoulder 54 of the body 30 and the first annular portion 130 of the locking mandrel 78 is ideally located behind the second cylindrical portion 124 of the lock ring 88. When the primary piston 72 is stroked downward into its lowered position, which corresponds to the locked condition of the tieback connector 10 (shown on the right-hand side of FIG. 1), the first and second tapered portions 134,136 of the locking mandrel 78 will ride over the corresponding first and second conical portions 126, 128 of the lock ring 88 and thereby allow the first and second annular portions 130, 132 of the locking mandrel to slide down behind the first and second cylindrical portions 122, 124 of the lock ring, respectively. In addition to the engagement of the second tapered portion 136 with the second conical portion 128, the engagement of the first tapered portion 134 with the first conical portion 126, which is ideally located about midway between the bottom surface 116 and the top edge 118, will effect a substantially uniform radial movement of the lock ring 88 towards the locking grooves 28. This action will thus force the lock ring 88 radially inwardly into the locking grooves 28 and thereby connect the body 30 to the wellhead 14.

Thus, in the locked condition of the tieback connector 10, the stepped interface between the locking mandrel 78 and the lock ring 88 provides two distinct bearing surfaces through which the separation forces acting on the tieback connector are transmitted. The first bearing surface is the interface between the first annular portion 130 of the locking mandrel 78 and the first cylindrical portion 122 of the lock ring 88. The second bearing surface is the interface between the second annular portion 132 of the locking mandrel 78 and the second cylindrical portion 124 of the lock ring 88.

The provision of these two distinct bearing surfaces provides the tieback connector 10 with a relatively high load bearing capability. The different diameters of the bearing surfaces, combined with the enhanced stiffness of the lower portion of the lock ring 88 due to its increased thickness, tends to distribute the separation forces more evenly among all the locking grooves. Consequently, for a given anticipated set of separation forces, the overall diameter of the tieback connector 10 can be reduced. This is particularly advantageous when the tieback connector 10 is intended to be used with a slimline production riser.

In accordance with one embodiment of the present invention, the primary piston 72 is actuated hydraulically to lock and unlock the tieback connector 10. Referring again to FIG. 2, the tieback connector 10 of this embodiment comprises a first piston chamber 138 which is formed between the body 30 and the primary piston 72 by the first and second seals 80, 82, and a second piston chamber 140 which is formed between the body 30 and the primary piston 72 by the second seal 82 and either the third and fourth seals 90, 92, when the secondary piston 74 is present, or the fifth and sixth seals 94, 96, when the secondary piston is not present.

Referring again to FIG. 1, the first piston chamber 138 is fluidly connected to a lock port 142 which extends through the primary piston 72. The lock port 142 in turn is fluidly connected to a first elongated nipple 144 which extends through a corresponding bore in the body 30. The first nipple 144 comprises a first end 146 which is secured such as by threads to the top of the primary piston 72 and a second end 148 which is connected to a source of hydraulic fluid (not shown). The second piston chamber 140 is fluidly connected to an unlock port 150 which extends through the primary piston 72. The unlock port 150 in turn is fluidly connected to a second elongated nipple 152 which extends through a corresponding bore in the body 30. The second nipple 152 comprises a first end 154 which is secured to the top of the primary piston 72 and a second end 156 which is connected to the source of hydraulic fluid. In addition, although not shown in the drawings, each of the piston chambers 138, 140 may also be fluidly connected to a corresponding compensation port in the primary piston 72 which in turn is connected to an accumulator by a respective nipple.

In order to lock the tieback connector 10 to the wellhead 14, hydraulic fluid is supplied to the first piston chamber 138 to force the primary piston 72 downward into its lowered position. This in turn will move the locking mandrel 78 downward and thereby force the lock ring 88 into the locking grooves 28, as discussed above. In order to unlock the tieback connector 10 from the wellhead 14, hydraulic fluid is supplied to the second piston chamber 140 to force the primary piston 72 upward into its raised position. This in turn will raise the locking mandrel 78 and thereby allow the lock ring 88 to retract from the locking grooves 28.

In accordance with another embodiment of the present invention, the secondary piston 84 is actuated hydraulically to move the primary piston 72 from its lowered position to its raised position in order to unlock the tieback connector 10 in the event of a failure of the hydraulic circuit supplying the primary piston. Accordingly, the tieback connector 10 also comprises a third piston chamber 158 which is formed between the body 30 and the primary piston 72 by the third and fourth seals 90, 92 and the fifth and sixth seals 94, 96. Similar to the first and second piston chambers 138, 140, the third piston chamber 158 is fluidly connected to a port (not shown) which extends through the primary piston 72 to a third elongated nipple 160 that is connected to the source of hydraulic fluid. The third piston chamber 158 may also be fluidly connected to a corresponding compensation port in the primary piston 72 which in turn is connected to an accumulator by a respective nipple.

Thus, if under normal operation of the tieback connector 10 the primary piston 72 cannot be moved from its lowered position to its raised position, hydraulic fluid can be supplied to the third piston chamber 158 to move the secondary piston 84 upwards. As the secondary piston 84 rises, it will engage the head portion 76 of the primary piston 72 and push the primary piston into its raised position. In this position, the tieback connector 10 will be unlocked from the wellhead 14.

Figure 4:
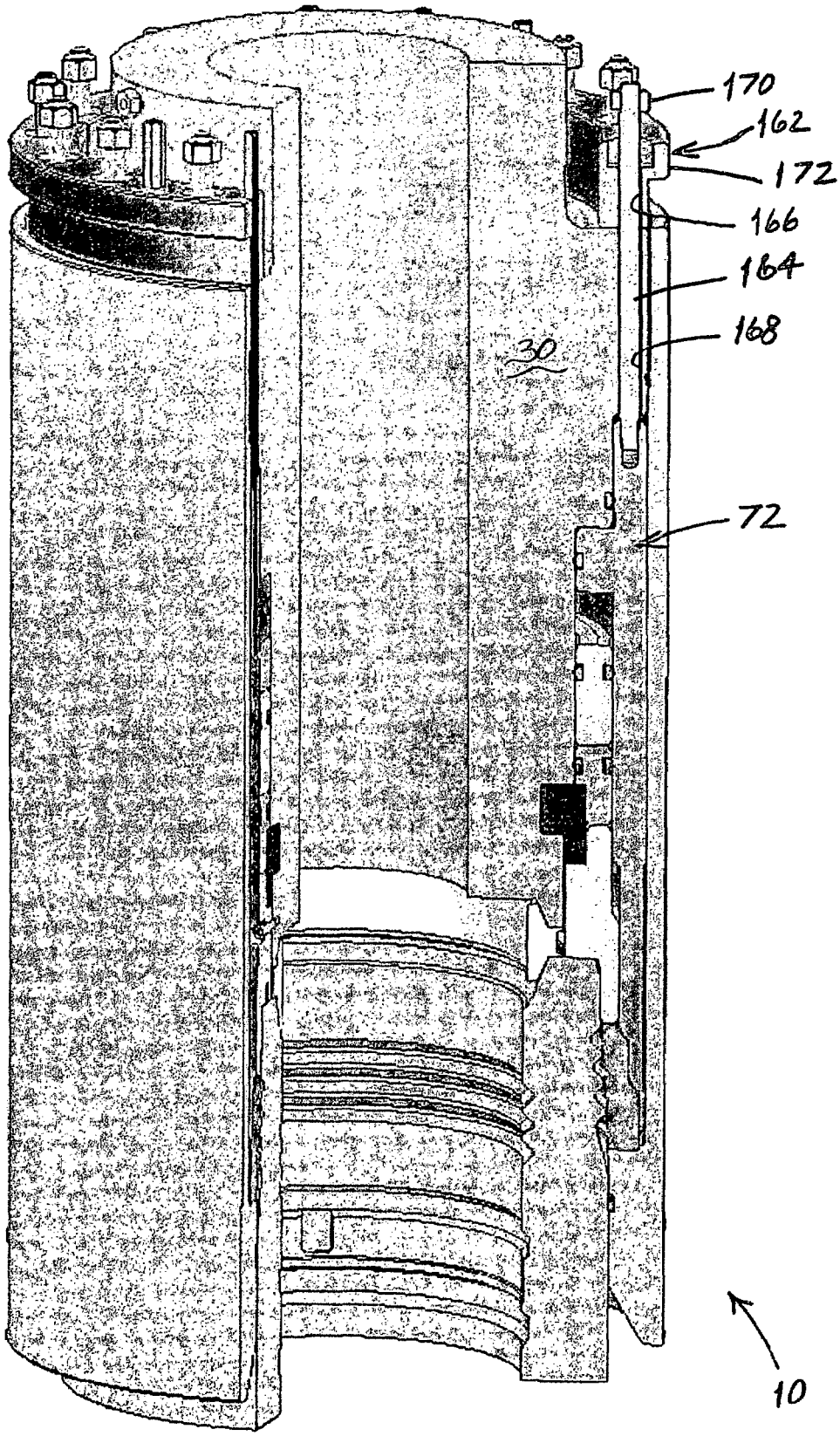
FIG. 4 is a longitudinal cross sectional view of the tieback connector of FIG. 1, but shown in a different cross sectional plane.

In accordance with yet another embodiment of the invention, the tieback connector 10 also includes mechanical means for moving the primary piston 72 from its lowered position to its raised position in the event of a failure of the hydraulic circuits supplying the primary and secondary pistons 72, 84. Referring to FIG. 4, in this embodiment the tieback connector 10 includes an annular release plate 162 which is supported on the flange portion 46 of the body 30. The release plate 162 is connected to the primary piston 72 by a number of lift rods 164, each of which extends through a corresponding pair of aligned holes 166 and 168 in the release plate and the body 30, respectively. Each lift rod 164 includes a first end which is secured such as by threads to the primary piston 72 and a second end to which a lift nut 170 is connected. In addition, the release plate 162 optimally includes a circular lip 172 or similar means which can be readily grasped by a remotely operated vehicle ("ROV"), a tool which is lowered from a surface vessel, or the like.

Thus, as the release plate 162 is lifted, it will engage the lift nuts 170 and pull the lift rods 164 upwards. The lift rods 164 will in turn pull the primary piston 72 upwards into its raised position. In this regard, it should be noted that the lift rods 164 are sufficiently long to allow the primary piston 72 to move from its raised position to its lowered position without interference from the release plate 162. Also, the lift rods 164 and the lift nuts 170 will provide a visual indication of whether the primary piston 72 is in its raised or lowered position.

In operation, the tieback connector 10 is attached to an end of the production riser 12 at a surface facility, such as a floating production vessel, and then lowered on the production riser toward the subsea wellhead 14. Once the tieback connector 10 is landed on the wellhead 14, the primary piston 72 is actuated to lock the tieback connector to the wellhead. When it is desired to disconnect the production riser 12 from the wellhead 14, the primary piston is again actuated to unlock the tieback connector 10 from the wellhead. In the event of a failure of the hydraulic circuit supplying the primary piston 72, the tieback connector 10 can be unlocked from the wellhead 14 by either actuating the secondary piston 84 or lifting the release plate 162.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A connector for securing a first generally cylindrical member to a second generally cylindrical member which includes a number of locking grooves that are formed therein, the connector comprising:

a generally cylindrical body which includes a first end that is attached to the first member and a second end that is positioned proximate the second member;

a generally cylindrical housing sleeve which is positioned concentrically over the body and which includes an upper end portion that is secured to the body and a lower end portion that is disposed adjacent the second member;

a generally cylindrical primary piston which is positioned between the body and the housing sleeve;

a locking mandrel which is connected to or formed integrally with the primary piston and which includes at least first and second annular portions that have different diameters;

a lock ring which is supported by the lower end portion of the housing sleeve adjacent the locking grooves and which includes at least first and second cylindrical portions that correspond to the first and second annular portions of the locking mandrel;

wherein movement of the primary piston from a first position to a second position will force the first and second annular portions of the locking mandrel into engagement with the first and second cylindrical portions of the lock ring, respectively, and consequently force the lock ring into engagement with the locking grooves to thereby lock the connector to the second member;

first means for moving the primary piston from the first position to the second position, the first moving means comprising:

a first sealed piston chamber which is formed between the body and a first portion of the primary piston; and first means for fluidly connecting the first piston chamber to a source of hydraulic fluid;

wherein the first fluid connecting means comprises:

a first nipple which includes a first end that is connected to the source of hydraulic fluid and a second end that is secured to the primary piston; and a first port which extends through the primary piston and which includes a first end that is connected to the first piston chamber and a second end that is connected to the second end of the first nipple.

2. The connector of claim 1, further comprising second means for moving the primary piston from the second position to the first position to thereby unlock the connector from the second member.

3. The connector of claim 2, wherein the second moving means comprises:

a second sealed piston chamber which is formed between the body and a second portion of the primary piston; and second means for fluidly connecting the second piston chamber to the source of hydraulic fluid.

4. The connector of claim 3, wherein the second fluid connecting means comprises:

a second nipple which includes a first end that is connected to the source of hydraulic fluid and a second end that is secured to the primary piston; and a second port which extends through the primary piston and which includes a first end that is connected to the second piston chamber and a second end that is connected to the second end of the second nipple.

5. The connector of claim 1, wherein the lock ring comprises a split lock ring.

6. The connector of claim 2, further comprising third means for moving the primary piston from the second position to the first position to thereby unlock the connector from the second member.

7. The connector of claim 6, wherein the third moving means comprises:

an annular secondary piston which is positioned concentrically around the body; and fourth means for moving the secondary piston against a portion of the primary piston to thereby move the primary piston into the first position.

8. The connector of claim 6, wherein the third moving means comprises:

an annular release plate which is supported on the body; and a number of lift rods, each of which extends through a corresponding hole in the body and includes a first end which is secured to the primary piston and a second end which is connected to the release plate.

9. The connector of claim 6, wherein the third moving means comprises:

an annular release plate which is supported on the body;

a number of lift rods, each of which extends through a corresponding pair of aligned holes in the release plate and the body and includes a first end which is secured to the primary piston and a second end which extends above the release plate; and a number of lift nuts, each of which is secured to the second end of a corresponding lift rod;

wherein the length of the lift rods is sufficient to enable the primary piston to move from its first position to its second position without interference from the release plate.

10. A connector for securing a first generally cylindrical member to a second generally cylindrical member which includes a number of locking grooves that are formed therein, the connector comprising:

a generally cylindrical body which includes a first end that is attached to the first member and a second end that is positioned proximate the second member;

a generally cylindrical housing sleeve which is positioned concentrically over the body and which includes an upper end portion that is secured to the body and a lower end portion that is disposed adjacent the second member;

a generally cylindrical primary piston which is positioned between the body and the housing sleeve;

a locking mandrel which is connected to or formed integrally with the primary piston and which includes at least first and second annular portions that have different diameters;

a lock ring which is supported by the lower end portion of the housing sleeve adjacent the locking grooves and which includes at least first and second cylindrical portions that correspond to the first and second annular portions of the locking mandrel;

wherein movement of the primary piston from a first position to a second position will force the first and second annular portions of the locking mandrel into engagement with the first and second cylindrical portions of the lock ring, respectively, and consequently force the lock ring into engagement with the locking grooves to thereby lock the connector to the second member;

first means for moving the primary piston from the first position to the second position, the first moving means comprising:

a first sealed piston chamber which is formed between the body and a first portion of the primary piston; and first means for fluidly connecting the first piston chamber to a source of hydraulic fluid;

second means for moving the primary piston from the second position to the first position to thereby unlock the connector from the second member;

wherein the second moving means comprises:

an annular secondary piston which is positioned concentrically around the body; and third means for moving the secondary piston against a portion of the primary piston to thereby move the primary piston into the first position.

11. The connector of claim 10, wherein the third moving means comprises:

a third sealed piston chamber which is formed between the body and the primary piston adjacent the secondary piston; and third means for fluidly connecting the third piston chamber to the source of hydraulic fluid.

12. The connector of claim 10, further comprising fourth means for moving the primary piston from the second position to the first position to thereby unlock the connector from the second member.

13. The connector of claim 12, wherein the fourth moving means comprises:

an annular release plate which is supported on the body; and a number of lift rods, each of which extends through a corresponding hole in the body and includes a first end which is secured to the primary piston and a second end which is connected to the release plate.

14. The connector of claim 12, wherein the fourth moving means comprises:

an annular release plate which is supported on the body;

a number of lift rods, each of which extends through a corresponding pair of aligned holes in the release plate and the body and includes a first end which is secured to the primary piston and a second end which extends above the release plate; and a number of lift nuts, each of which is secured to the second end of a corresponding lift rod;

wherein the length of the lift rods is sufficient to enable the primary piston to move from its first position to its second position without interference from the release plate.

15. A connector for securing a first generally cylindrical member to a second generally cylindrical member which includes a number of locking grooves that are formed therein, the connector comprising:

a generally cylindrical body which includes a first end that is attached to the first member and a second end that is positioned proximate the second member;

a generally cylindrical housing sleeve which is positioned concentrically over the body and which includes an upper end portion that is secured to the body and a lower end portion that is disposed adjacent the second member;

a generally cylindrical primary piston which is positioned between the body and the housing sleeve;

a locking mandrel which is connected to or formed integrally with the primary piston and which includes at least first and second annular portions that have different diameters;

a lock ring which is supported by the lower end portion of the housing sleeve adjacent the locking grooves and which includes at least first and second cylindrical portions that correspond to the first and second annular portions of the locking mandrel;

wherein movement of the primary piston from a first position to a second position will force the first and second annular portions of the locking mandrel into engagement with the first and second cylindrical portions of the lock ring, respectively, and consequently force the lock ring into engagement with the locking grooves to thereby lock the connector to the second member;

first means for moving the primary piston from the first position to the second position, the first moving means comprising:

a first sealed piston chamber which is formed between the body and a first portion of the primary piston; and first means for fluidly connecting the first piston chamber to a source of hydraulic fluid;

second means for moving the primary piston from the second position to the first position to thereby unlock the connector from the second member;

wherein the second moving means comprises:

an annular release plate which is supported on the body; and a number of lift rods, each of which extends through a corresponding hole in the body and includes a first end which is secured to the primary piston and a second end which is connected to the release plate.

16. The connector of claim 15, further comprising third means for moving the primary piston from the second position to the first position to thereby unlock the connector from the second member.

17. The connector of claim 16, wherein the third moving means comprises:

an annular secondary piston which is positioned concentrically around the body; and fourth means for moving the secondary piston against a portion of the primary piston to thereby move the primary piston into the first position.

18. A connector for securing a first generally cylindrical member to a second generally cylindrical member which includes a number of locking grooves that are formed therein, the connector comprising:

a generally cylindrical body which includes a first end that is attached to the first member and a second end that is positioned proximate the second member;

a generally cylindrical housing sleeve which is positioned concentrically over the body and which includes an upper end portion that is secured to the body and a lower end portion mat is disposed adjacent the second member;

a generally cylindrical primary piston which is positioned between the body and the housing sleeve;

a locking mandrel which is connected to or formed integrally with the primary piston and which includes at least first and second annular portions that have different diameters;

a lock ring which is supported by the lower end portion of the housing sleeve adjacent the locking grooves and which includes at least first and second cylindrical portions that correspond to the first and second annular portions of the locking mandrel;

wherein movement of the primary piston from a first position to a second position will force the first and second annular portions of the locking mandrel into engagement with the first and second cylindrical portions of the lock ring, respectively, and consequently force the lock ring into engagement with the locking grooves to thereby lock the connector to the second member;

first means for moving the primary piston from the first position to the second position, the first moving means comprising:

a first sealed piston chamber which is formed between the body and a first portion of the primary piston; and first means for fluidly connecting the first piston chamber to a source of hydraulic fluid;

second means for moving the primary piston from the second position to the first position to thereby unlock the connector from the second member;

wherein the second moving means comprises:

an annular release plate which is supported on the body;

a number of lift rods, each of which extends through a corresponding pair of aligned holes in the release plate and the body and includes a first end which is secured to the primary piston and a second end which extends above the release plate; and a number of lift nuts, each of which is secured to the second end of a corresponding lift rod;

wherein the length of the lift rods is sufficient to enable the primary piston to move from its first position to its second position without interference from the release plate.

19. The connector of claim 18, further comprising third means for moving the primary piston from the second position to the first position to thereby unlock the connector from the second member.

20. The connector of claim 19, wherein the third moving means comprises:

an annular secondary piston which is positioned concentrically around the body; and fourth means for moving the secondary piston against a portion of the primary piston to thereby move the primary piston into the first position.

* * * * *